United States Patent [19]

Schuster

[11] 3,955,350

[45] May 11, 1976

[54] FALSE TWISTER

[75] Inventor: Friedrich Schuster, Hammelburg, Germany

[73] Assignee: Kugelfischer Georg Schafer & Co., Schweinfurt, Germany

[22] Filed: Dec. 10, 1974

[21] Appl. No.: 531,316

[30] Foreign Application Priority Data

Dec. 11, 1973 Germany ..... 2361674

[52] U.S. Cl. ..... 57/77.4

[51] Int. Cl.[2] ..... D02G 1/04; D01H 7/92

[58] Field of Search ..... 57/77.3–77.45, 34 R

[56] References Cited

UNITED STATES PATENTS

| | | | |
|---|---|---|---|
| 3,287,890 | 11/1966 | McIntosh et al. | 57/77.4 |
| 3,762,149 | 10/1973 | Roschle | 57/77.4 |
| 3,854,276 | 12/1974 | Marzoli | 57/77.4 |
| 3,872,661 | 3/1975 | Eaves | 57/77.4 |

*Primary Examiner*—Donald E. Watkins

*Attorney, Agent, or Firm*—Stevens, Davis, Miller & Mosher

[57] ABSTRACT

An apparatus for false twisting threads has three spindles arranged to rotate about substantially parallel axes and fixed at the corners of a triangle centered on the mean path of the thread with friction elements carried by the spindles overlapping each other and means for moving a thread from a position outside the friction elements into a position where the thread follows a zig-zag path between the friction elements and is twisted thereby through an intermediate position where the thread first engages only some of the friction elements and is then moved into position for full rotation.

13 Claims, 7 Drawing Figures

FALSE TWISTER

The invention relates to apparatus for false-twisting threads, for example, for crimping synthetic threads, comprising three spindles arranged to rotate about substantially parallel axes at the corners of a triangle centered on the mean path of the thread and carrying friction elements which frictionally engage the thread and rotate it.

An apparatus for false-twisting threads wherein all three spindles are simultaneously adjustable towards and away from one another, while remaining at the corners of an equilateral triangle, to vary the overlap between the friction elements is disclosed in U.S. Pat. Application Ser. No. 342,085 filed for the assignee of this application on Mar. 16, 1973. During running of the apparatus the thread follows a zig-zag path between the rollers approximately through the center of the triangle.

In a further development of this disclosed apparatus, it has been proposed to facilitate threading of the yarn or thread by providing a hollow angularly movable bush or mandrel which is co-axial with the path of the thread. The mandrel is provided with an eccentric which projects between the spindles and has three cam surfaces against which the housing of each of the spindles is resiliently urged, the eccentric being movable between an open position in which the friction elements on the spindles leave free a central axial path for the thread, and a closed position in which they overlap.

The friction elements are, as a rule, in the form of circular rollers. The three spindles are coupled together so that they always rotate in the same direction. In order to impart an S-twist or a Z-twist to the thread as it always travels in the same direction through the apparatus, for example, in a downward direction, the direction of rotation of the spindles is correspondingly set to be clockwise or counter-clockwise, the friction elements being arranged so that, in addition to the twisting force component, the thread, as it passes between the friction elements, is also acted on by a force component acting in the direction of travel of the thread.

False twisters with three rotatably mounted spindles, which are arranged at a fixed mutual spacing at the corners of an equilateral triangle, are cheaper to manufacture but the spindle arrangement cannot be adjusted to achieve optimum setting of the overlap of the friction elements or for threading purposes. However, when the optimum setting is obtained and the spindles are clamped rigidly to the appropriately constructed base plate, this optimum setting is maintained. Moreover, it is possible to obtain repeatable values of the setting from spinning frame to spinning frame or from false-twister to false-twister with regard to height tolerances. However, problems arise in such false twisters, primarily in setting the thread in motion.

The thread which is to be false-twisted is threaded into the apparatus having rigidly fixed spindles without engaging the friction elements, and therefore without being subjected to rotation. From this diverted path clear of the friction elements it is then displaced, by means of suitable guide elements, into the false-twisting position in which it suddenly receives the full rotation from the continuously running friction elements. As a result of the relatively high lateral acceleration of the thread on movement from the diverted position into the false-twisting position, the sudden full imparting of the false twist, shortening the thread, and the additional stretching necessary for the zig-zag path of the thread, cause the thread to be loaded excessively so that repeated breakages of the thread occur and the step of setting the thread in motion is unreliable.

Accordingly, it is an object of this invention to overcome these drawbacks and to provide an apparatus for false-twisting threads which sets the thread in motion in a convenient and satisfactory manner. Another object of the invention is to provide an apparatus having three spindles fixed at the corners of an equilateral triangle and carrying overlapping friction elements with a new and improved means for moving a thread or yarn into a false-twisting position between the spindles.

The invention is based on the concept of not immediately shifting the thread to be false-twisted from the diverted position to the false-twisting position after threading up, but achieving this via a stable intermediate position in which the thread at first only receives a fraction of the full rotation, for example 25% to 50%. Thereafter the thread is moved to the false-twisting position with only low lateral acceleration. The rotational speed increases slowly. The shortening of the thread by the imparting of the twist and the stretching of the thread as a result of its zig-zag path are introduced slowly.

The invention provides moreover the advantage that the same thread guiding elements can be used without modification both on clockwise and counterclockwise false twisters.

Some embodiments of the invention are described in the following by way of example with reference to the drawing. In the drawing.

Figure 2:
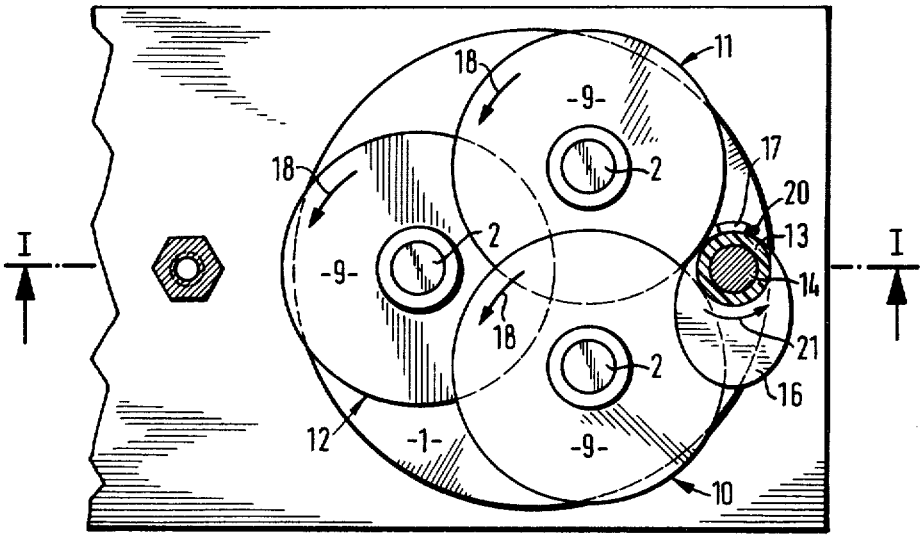
FIG. 2 is a cross-section along the line II—II in FIG. 1.
Figure 5:
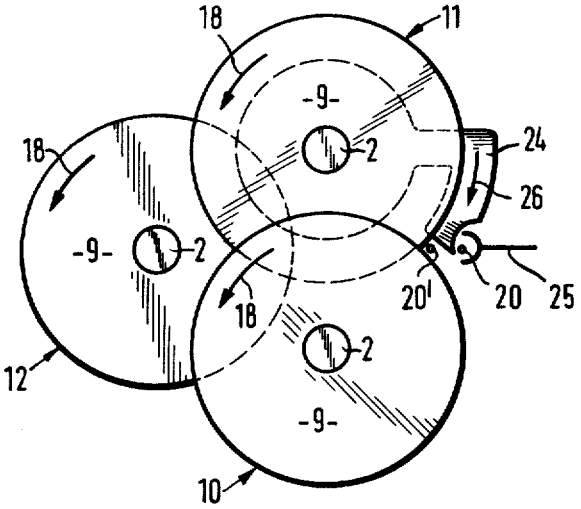
Figure 6:
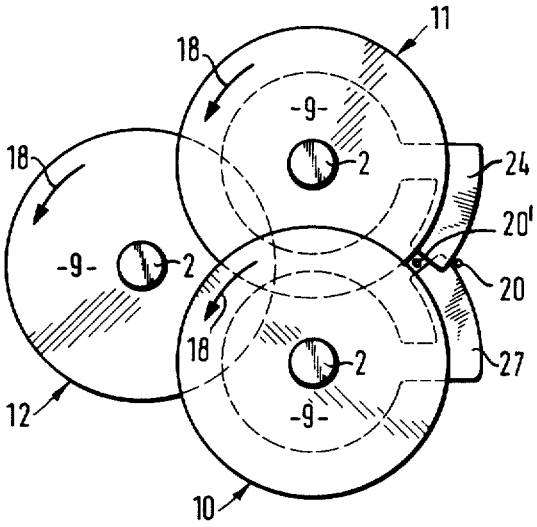
Figure 7:
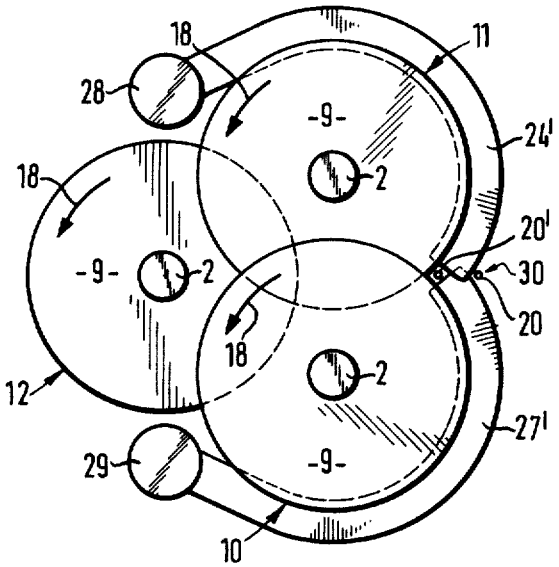

FIGS. 5 to 7 each show diagrammatically a further embodiment, the thread-guiding elements being in the position shown in FIG. 2.

The false twister comprises a base plate 1 carrying three spindles 2 which, in plan view, lie at the corners of an equilateral triangle. Each spindle 2 is provided with a sealed bearing 3 which is secured to the base plate 1 by means of a nut 4. Futhermore, at its lower end as viewed in FIG. 1, each spindle 2 is provided with an externally toothed wheel 5. All three wheels 5 are enclosed by a common toothed belt 6.

Furthermore, the apparatus includes a fixed eye-shaped thread guide 7 and a fixed anti-ballooning tube 8. The thread guide 7 and the anti-ballooning tube 8, which passes through the base plate 1, lie on a common axis which, in the version illustrated, passes through the center of the above-mentioned equilateral triangle of spindles.

Figure 1:
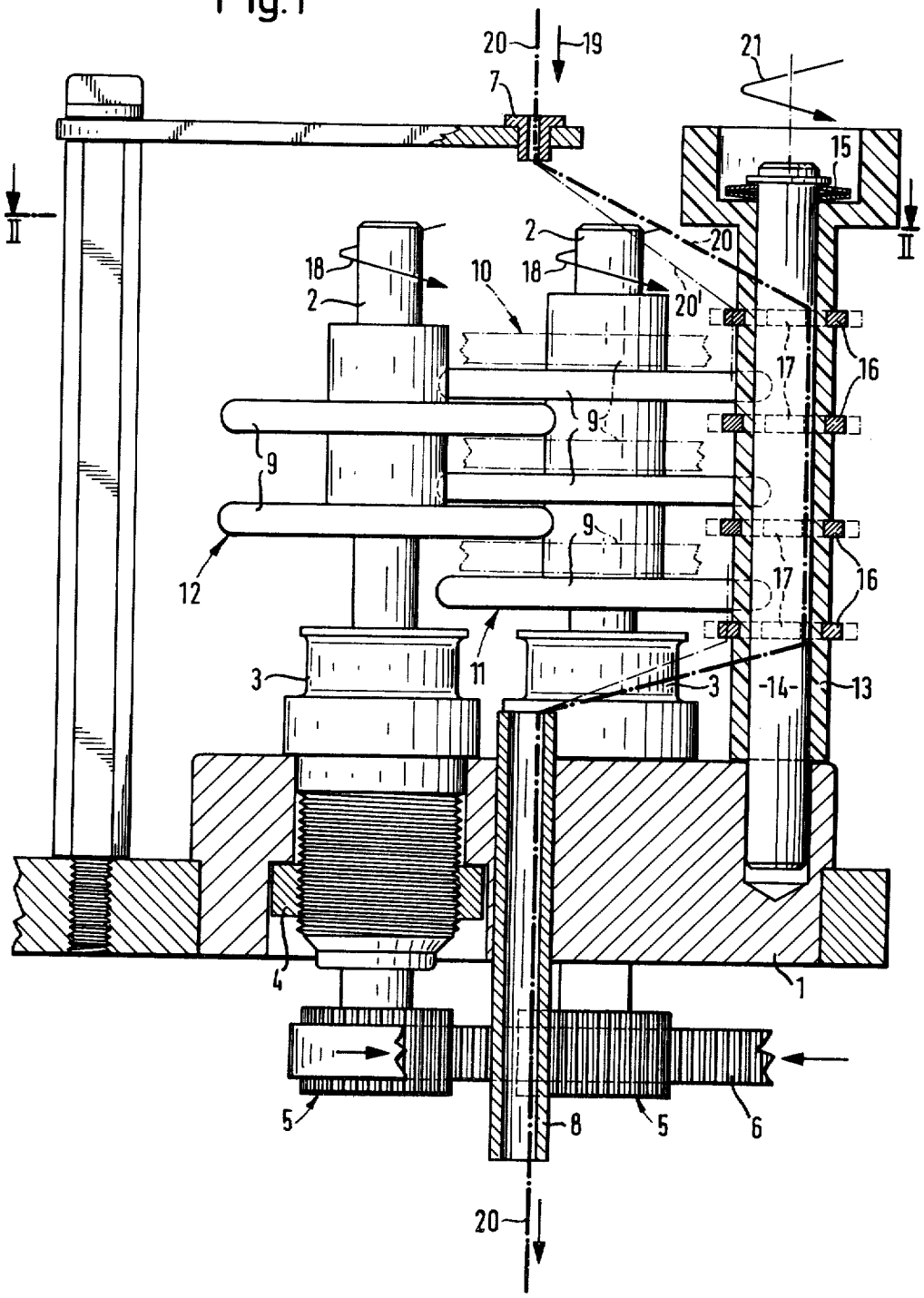
FIG. 1 is a longitudinal section along the line I—I in FIG. 2 through a first preferred embodiment of the apparatus according to the invention.

Secured to each spindle 2 is a set of friction rollers 9. The rollers 9 of each spindle 2 overlap the rollers 9 on the other two spindles 2. While the two right hand sets 10 and 11, as viewed in FIGS. 1 and 2, each have three friction rollers 9, the left hand set 12 only has two rollers 9. For clearer understanding the position of the set of rollers 10 is illustrated in FIG. 1 only in broken lines.

On that side of the sets 10 and 11 of friction rollers which is remote from the set 12 there is provided a sleeve 13 which is rotatably mounted on a fixed pivot pin 14 on the base plate 1, extending parallel to the spindles 2. The sleeve 13 is urged by plate springs 15 against the base plate 1 sothat between the latter and the sleeve 13 there is a certain degree of friction and the sleeve 13 is held fast in any angular position to which it is set on the pin 14.

The sleeve 13 carries four tongues 16 of oval outline which are each joined to the sleeve 13 near one end and at this end they each have a small cam 17 facing away from the axis of the sleeve. The tongues 16 are all aligned one above the other, i.e., the periphery of each tongue 16 lies within the vertical projection of the periphery of each other tongue 16, and the same applies to the cams 17.

Important are the two middle tongues 16 which each lie opposite a roller 9 of the set 12, the arrangement being such that the tongue 16 and the associated roller 9 of the set 12 lie in the same horizontal plane. The two outer tongues 16 are not absolutely essential.

In operation, the spindles 2 all run in the same direction of rotation, for example, so that the rollers 9 rotate in the direction of the arrow 18 in FIG. 2. the thread 20, which runs through the device in the direction of the arrow 19, that is to say in a downward direction, is therefore given a Z twist or counterclockwise twist.

FIGS. 1 and 2 show the sleeve 13 and the thread guiding elements 16 in that position in which the thread 20 is initially threaded up. The thread 20 is passed through the thread guide 7, passed along the sides of the cams 17 which are furthest from the friction discs 9, and is then guided through the anti-ballooning tube 8. In this diverted position of the thread there is no contact with the friction discs 9, which are rotating at a speed, for example, of 5000 r.p.m.

Figure 3:
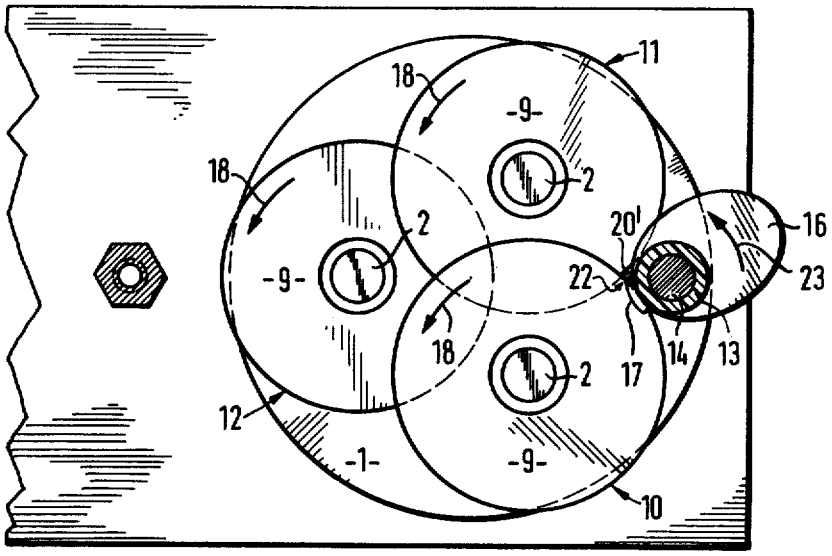
FIGS. 3 and 4 are each in the form of a cross-section corresponding to FIG. 2 in which the thread-guiding elements take up different positions.

To cause engagement of the thread 20 the sleeve 13 is now turned in the direction of the arrow 21 until the tongues 16 and the cams 17 take up the position shown in FIG. 3. In this stable intermediate position 20' the thread 20 runs in the external wedge-shaped gap 22 between the sets of friction rollers 10 and 11, engaging the rollers 9 of the latter. In this position, the thread 20 has imparted to it only about 25% to 50% of the full rotation.

Figure 4:
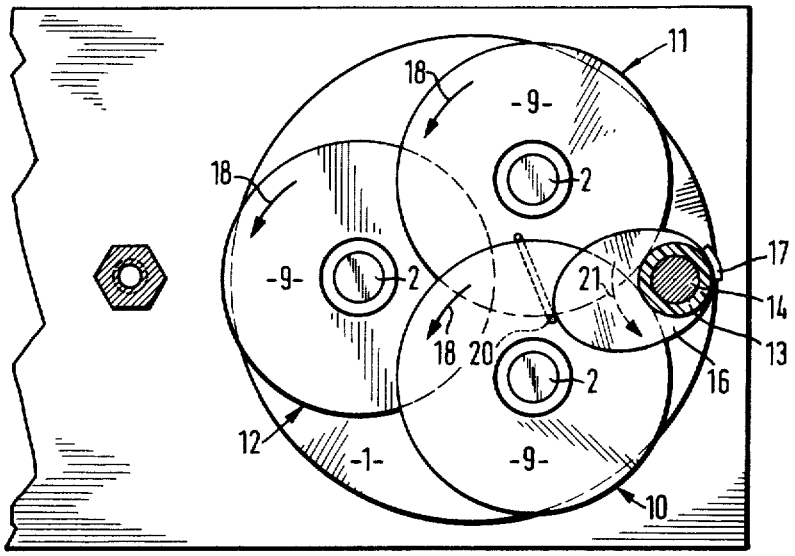

The sleeve 13 is then turned further in the direction of the arrow 23 so that the tongues 16 and the cams 17 take up the position shown in FIG. 4. As a result of the shape of the peripheries of the tongues 16, the thread is gently displaced laterally, i.e., towards the center of the triangle of spindles. From the position shown in FIG. 4 the thread 20 moves of its own accord into the final false-twisting position, in which it passes along a zig-zag path between the friction rollers 9 on the spindles 2 which are mounted at fixed mutual spacing, until it receives the full rotation.

In order to change over from counterclockwise to clockwise rotation it is only necessary to reverse the direction of rotation 18 of the rollers 9 and to exchange the sets 10 and 11 of friction discs so that the uppermost disc 9, at the thread entry face, is on the spindle 2 which is nearer the top of FIG. 2 and in the region between the sleeve 13 and the center of the triangle of spindles its periphery is moving towards the center of that triangle. In the diverted position of the thread 20 the tongues 16 are then pointed upwards in FIG. 2 and the cams 17 are downwards. The sleeve 13 is angularly displaced from this position in the opposite direction to the arrow 21 to reach the stable intermediate position for setting the thread 20 in motion and then it is turned further to the position corresponding to FIG. 4. Because of their symmetrical construction, no displacement or alteration of the sleeve 13 or the tongues 16 is necessary on account of their symmetrical construction. In addition to, or instead of, the sleeve 13 being steplessly adjustable with friction, one can also provide a detent type of location to locate it in predetermined angular positions.

The embodiments shown in FIGS. 5 to 7 differ from those of FIGS. 1 to 4 simply in that they employ different forms of thread guiding elements. In the embodiment shown in FIG. 5 the thread guiding elements are in the form of hook-shaped levers 24. All the levers 24 are arranged to pivot together around the axis of one of the spindles 2. In the position shown in FIG. 5 they hold the thread 20 in the diverted position mentioned. From this position the thread 20 can be brought into the stable intermediate position 20', for example, by the use of a fork 25, and is then brought into the false-twisting position by pivoting the lever 24 in the direction of the arrow 26.

The embodiment shown in FIG. 6 differs from that of FIG. 5 in that, in addition, a second one of the spindles 2 carries hook-shaped levers 27, which can pivot together. The two sets of levers 24 and 27 cooperate face to face in such a way that when they are in the positions shown in FIG. 6 the thread 20 is held in its diverted position. On momentary pivotal movement of one or both sets of levers 24 and 27, the thread moves to the stable intermediate position 20', and it can then be pushed further into the false-twisting position by turning one of the two sets of levers 24 and 27.

The embodiment shown in FIG. 7 corresponds substantially to that of FIG. 6 apart from the fact that the sets of levers 24' and 27' are each rotatably mounted on a separate axis of rotation 28 and 29 respectively, parallel to the spindles 2, and the levers 24' and 27' are curved to a substantially semi-circular shape to hold the thread 20 in the diverted position shown in FIG. 7 in the outer wedge-shaped gap 30 formed by the overlapping of the free ends of the levers, as is the case in the embodiment of FIG. 6. By pivotal movement of at least one of the sets of levers 24' or 27', the thread 20 is then allowed to move into the stable intermediate position 20', to be subsequently pushed to the false-twisting position by one or both sets of levers 24' and 27'.

Although the invention has been described in detail for the purpose of illustration, it is to be understood that such detail is solely for that purpose and that variations therein can be made by those skilled in the art without departing from the spirit and scope of the invention except as it is limited by the claims.

I claim:

1. An apparatus for false-twisting threads comprising three spindles arranged to rotate about substantially parallel axes and fixed at the corners of a triangle centered on the mean path of the thread, friction elements secured to the spindles for rotation therewith, means for moving the thread between a diverted position clear of the friction elements and a false-twisting position in which the thread follows a zig-zag path between the friction elements comprising means for moving the thread to be shifted to a stable intermediate position and into engagement with at least one friction element of at least one spindle for starting up the false twisting.

2. Apparatus according to claim 1 wherein the stable intermediate position is one wherein the thread runs in an outer wedge-shaped gap between the friction elements on two adjacent spindles.

3. Apparatus according to claim 1 wherein the means for allowing the thread to be shifted act positively to push the thread gently from the intermediate position to the false-twisting position.

4. Apparatus according to claim 1 wherein the means for allowing the thread to be shifted comprise guiding elements which are movable together and which are associated with the friction elements of two adjacent spindles and are each arranged in a common transverse plane with a respective friction element of the third spindle.

5. Apparatus according to claim 4 wherein the thread guiding elements are tongues of oval outline and lugs are provided on a separate member rotatable about an axis parallel to the spindles.

6. Apparatus according to claim 5 wherein the angular position of the member is steplessly adjustable.

7. Apparatus according to claim 6 wherein the said member is acted on by spring means so as to be frictionally held in any angular position.

8. Apparatus according to claim 5 wherein the member is angularly movable to a number of positions in each of which it is located by detent means.

9. Apparatus according to claim 5 in which the member is of sleeve-like form and is rotatably mounted on a pivot pin carried on a base plate which carries the spindles.

10. Apparatus according to claim 4 wherein the thread guiding elements are formed as levers which pivot simultaneously about the axis of one of the spindles.

11. The apparatus of claim 10 comprising a second set of levers which pivot simultaneously about the axis of a seocnd one of the spindles, both sets of levers cooperating to guide the thread in the diverted position.

12. Apparatus according to claim 4 wherein the thread guiding elements are formed as levers, curved to substantially a semi-circle, which are arranged in two sets, each of which is capable of pivoting on a separate axis parallel to the spindles and which cooperate to guide the thread in the diverted position.

13. In an apparatus for false-twisting threads comprising three spindles each carrying a plurality of spaced friction elements fixed for rotation therewith, said spindles being arranged to rotate about substantially parallel axes and being fixed to the corners of a triangle which is centered about the mean path of the thread to be twisted, means for moving the thread into a position where it follows a zig-zag path between the friction elements where it will be twisted as the friction elements rotate comprising a pivoting means positioned to move the thread to a position from outside the friction elements to an intermediate position first where it will be engaged by only some of the friction elements of only one spindle and will thereafter be carried by the friction elements to the said mean path for false-twisting.

* * * * *